US005665926A

United States Patent [19]

Chen

[11] Patent Number: 5,665,926

[45] Date of Patent: Sep. 9, 1997

[54] MUSICAL BOX STRUCTURE

[76] Inventor: Chia-Shiang Chen, No. 11, Alley 65, Lane 201, Wu Lin Road, Hsinchu, Taiwan

[21] Appl. No.: 625,072

[22] Filed: Mar. 29, 1996

[51] Int. Cl.[6] ..... G10F 1/06

[52] U.S. Cl. ..... 84/95.2

[58] Field of Search ..... 84/95.2, 95.1, 84/94.2, 94.1; 446/297, 298, 265

[56] References Cited

U.S. PATENT DOCUMENTS 5,088,218 2/1992 Liu ..... 84/95.2

5,276,271 1/1994 Huang et al. ..... 84/94.2

*Primary Examiner*—Cassandra C. Spyrou

*Attorney, Agent, or Firm*—Morton J. Rosenberg; David I. Klein

[57] ABSTRACT

The invention relates to a music box comprising a base on the top of which is a driving mechanism housed inside an enclosure and further accommodated by a transparent casing. The music box uses the driving mechanism to drive the enclosure and the transparent casing to rotate in two opposite directions, displaying unique attraction.

1 Claim, 4 Drawing Sheets

MUSICAL BOX STRUCTURE

BACKGROUND OF THE INVENTION

A typical musical box generally has various designs provided on a rotary shell. The musical box employs a driving component to rotate the shell and to produce melodies. The sounding device is a set of spring plates that is sited in the vicinity of a drum having protrusions formed on the outer surface thereof. As the drum rotates, the protrusions are brought to stir up the spring plates, producing a tune.

The object of the invention is to provide a novel music box that can display more variations as the music box is turned on, i.e., different rotation directions of inner and outer shells.

The structure and features of the present invention will be now described in detail with reference to the accompanying drawings.

BRIEF DESCRIPTION OF THE ACCOMPANYING DRAWINGS

DETAILED DESCRIPTION OF AN PREFERRED EMBODIMENT

Figure 1:
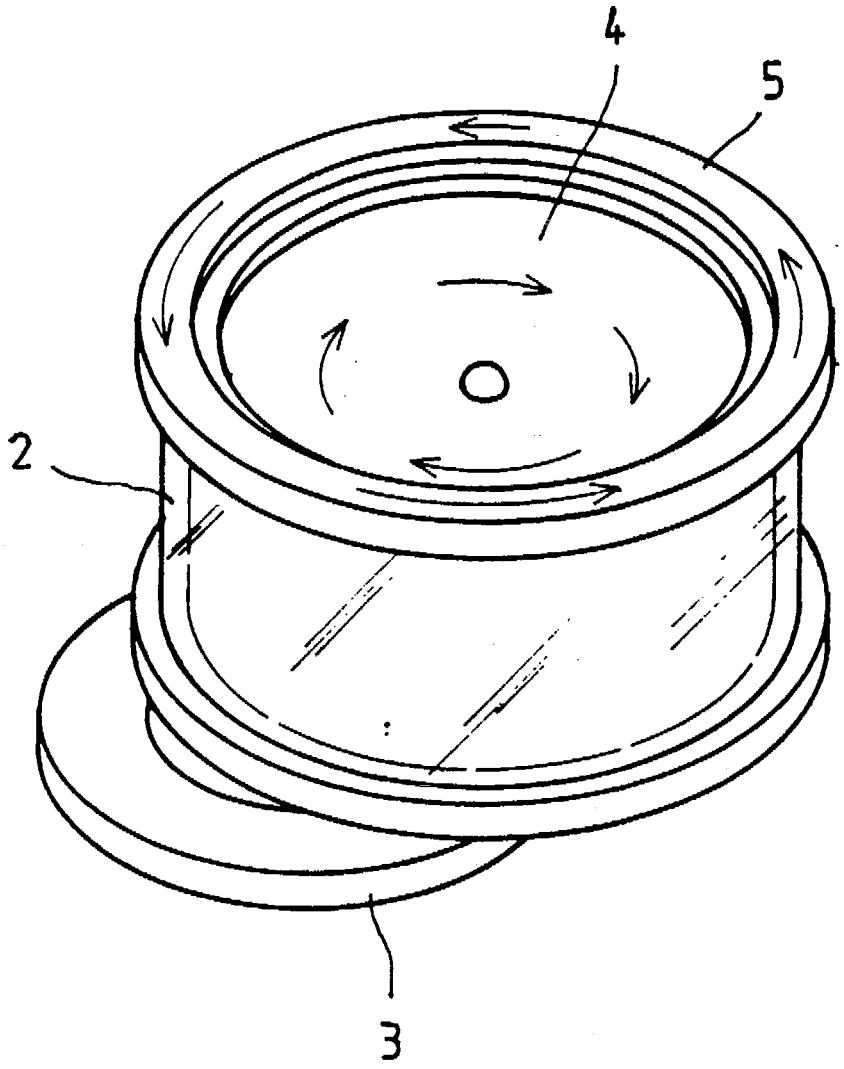
FIG. 1 is a perspective view of a musical box of the invention.
Figure 2:
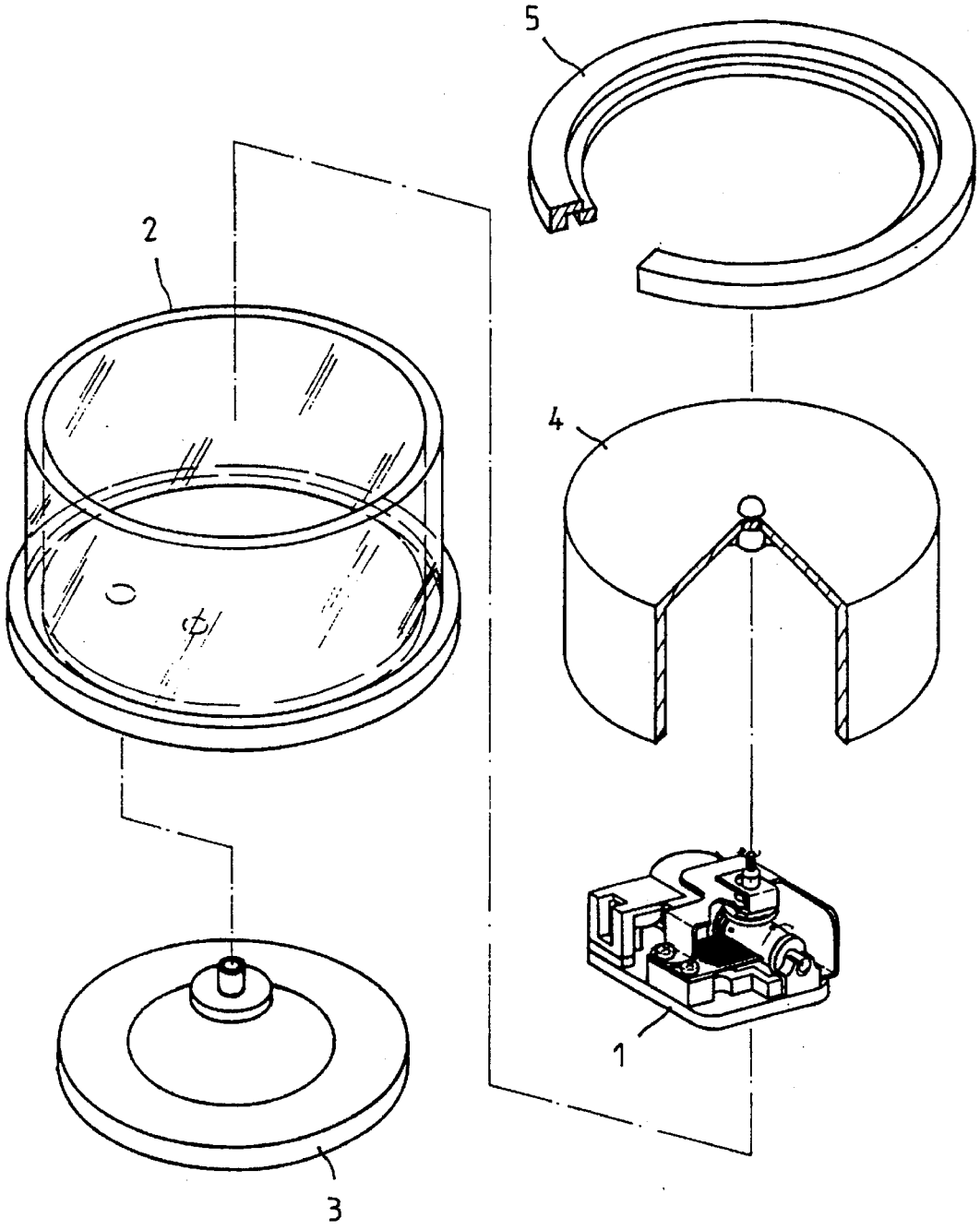
FIG. 2 is an exploded view of the musical box of FIG. 1.
Figure 3:
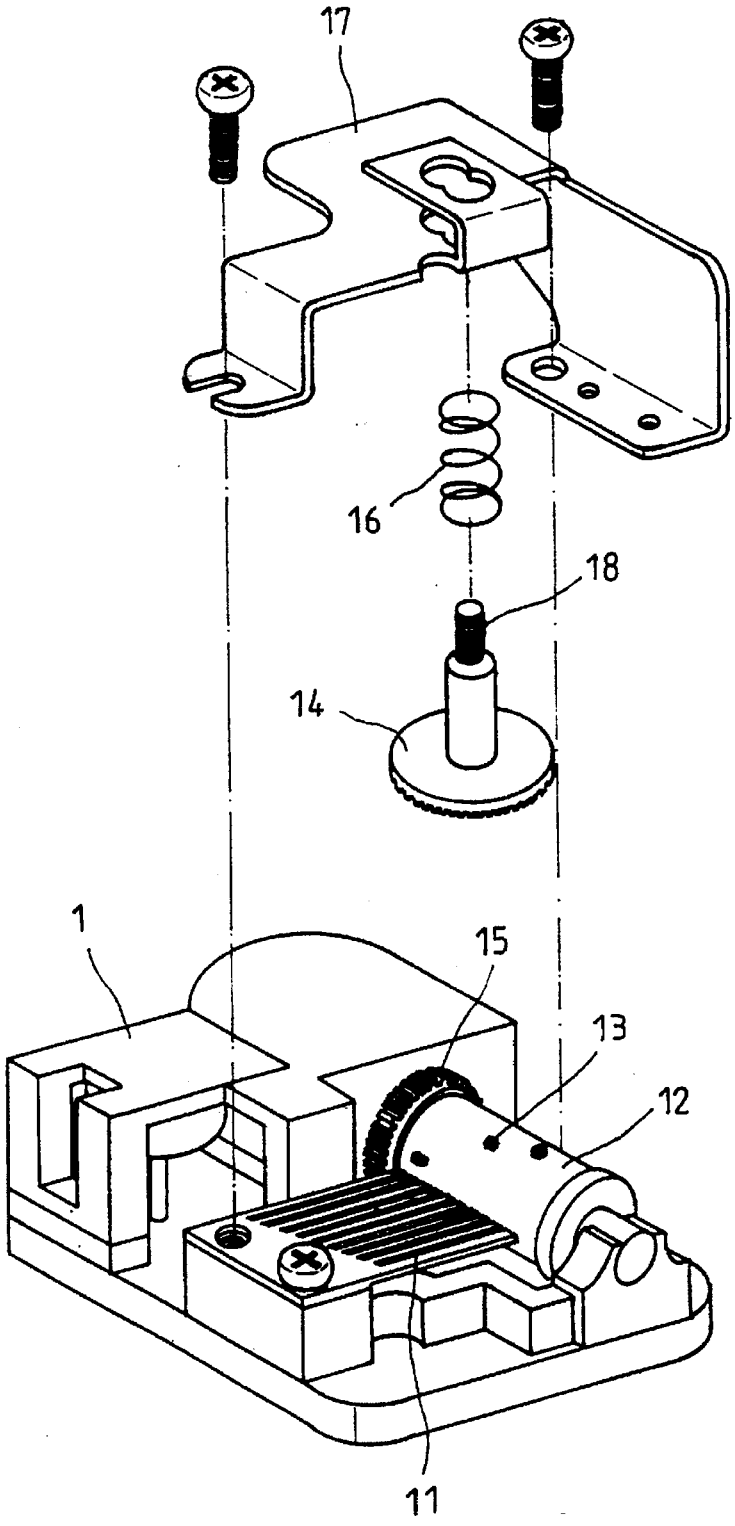
FIG. 3 is an exploded view showing the driving part of the musical box of FIG. 1.
Figure 4:
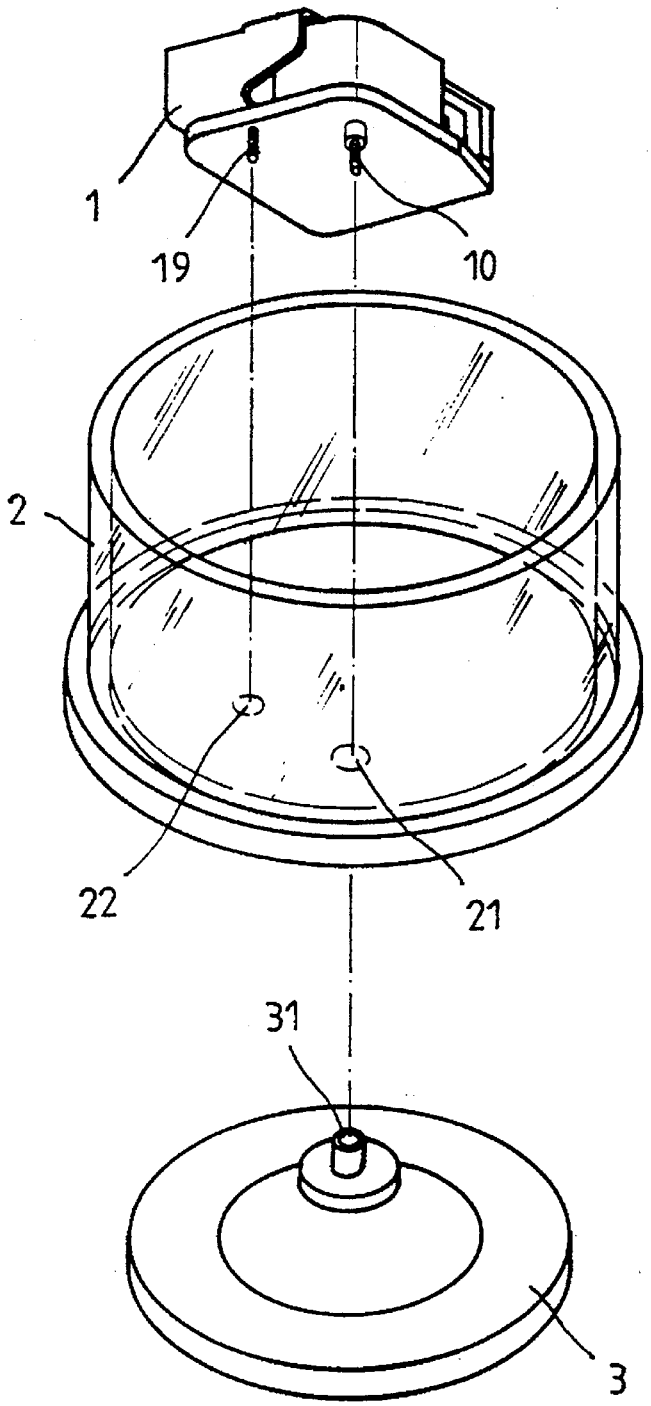
FIG. 4 is another exploded view showing the casing parts of the musical box.

With reference to the accompanying drawings, the musical box of the invention includes a driving mechanism (1) on the bottom face of which is provided an axle rod (10) extending through a hole (21) formed on the bottom of a transparent casing (2) and affixed to the a bush (31) of a base (3). The driving mechanism (1) is covered by an enclosure (4) and housed inside the transparent casing (2), with a bracing (5) disposed on the top of the casing to hold them.

The aforementioned driving mechanism (1) includes a common musical spring (11) and a drum (12). The vibrations of the spring (11) caused by the protrusions (13) formed on the drum (12) can produce melodies. According to the invention, the driving mechanism (1) comprises a toothed wheel (14) that is engaged with teeth (15) formed in the outer surface of the drum (12). A spring (16) is mounted on the top of the toothed wheel (14) and secured by a bracket (17) to the base of the driving mechanism. A threaded stud (18) formed on the top of the toothed wheel (14) is used as the connection means to attach the toothed wheel (14) to the enclosure (4). When the drum (12) is driven to rotate and to produce melodies by a motor installed on the base of the driving mechanism, the enclosure (4) and the toothed wheel (14) will simultaneously turn.

A pole (19) arranged on the bottom surface of the driving mechanism (1) extends through an opening (22) formed on the bottom of the transparent casing (2) to the base (3) so that as the enclosure (4) rotates, the casing (2) also turns around the axle rod (10) in a reverse direction. As a result, when the music box is turned on, the transparent casing (2) rotates in one direction and the enclosure (4) turns in the other direction, producing unique attraction. Hence the invention gives a totally different vision effect. Evidently the invention can achieve the expected object.

What is claimed is:

1. A music box comprising:

a driving mechanism including a bottom face and a drum having geared teeth;

a base comprising a bush;

a transparent casing having an axle hole and a lateral hole;

an axle rod extending from said bottom face of the drive mechanism and through said axle hole and then being affixed to said bush of the base;

a pole extending from said driving mechanism through the lateral hole to said base;

a bracket attaching a toothed wheel to the driving mechanism, said tooth wheel engaging the geared teeth of the drum; and, an enclosure housing said driving mechanism, said tooth wheel including a spring and a threaded stud, said threaded stud being attached to said enclosure, said transparent housing enveloping said enclosure.

* * * * *